US009752851B2

(12) United States Patent
Orlob

(10) Patent No.: US 9,752,851 B2
(45) Date of Patent: Sep. 5, 2017

(54) FIREARM SIGHT AND METHOD FOR OCCLUDING VISION OF SHOOTER'S NON-AIMING EYE

(71) Applicant: Douglas Orlob, Walla Walla, WA (US)

(72) Inventor: Douglas Orlob, Walla Walla, WA (US)

( * ) Notice: Subject to any disclaimer, the term of this patent is extended or adjusted under 35 U.S.C. 154(b) by 0 days.

(21) Appl. No.: 13/815,535

(22) Filed: Mar. 7, 2013

(65) Prior Publication Data

US 2014/0250758 A1 Sep. 11, 2014

(51) Int. Cl.

| | |
|---|---|
| ***F41G 1/01*** | (2006.01) |
| ***F41G 1/34*** | (2006.01) |
| ***F41G 1/08*** | (2006.01) |
| ***F41G 1/10*** | (2006.01) |

(52) U.S. Cl.

CPC ..... *F41G 1/345* (2013.01); *F41G 1/01* (2013.01); *F41G 1/08* (2013.01); *F41G 1/10* (2013.01)

(58) Field of Classification Search

CPC ..... F41G 1/01; F41G 1/08; F41G 1/10; F41G 1/12; F41G 1/345

USPC ..... 42/112, 132, 133, 143, 144, 145

See application file for complete search history.

(56) References Cited

U.S. PATENT DOCUMENTS

| | | | | |
|---|---|---|---|---|
| 1,363,553 | A * | 12/1920 | Barringer | F41G 1/12 42/145 |
| 3,777,380 | A * | 12/1973 | Theodore | 42/144 |
| 4,200,989 | A | 5/1980 | Brouthers | |
| 4,388,772 | A | 6/1983 | Maes | |
| 4,628,611 | A | 12/1986 | Ruffino | |
| RE35,347 | E | 10/1996 | Bindon | |
| 5,822,872 | A * | 10/1998 | Waki | 42/111 |
| 6,216,351 | B1 | 4/2001 | Flubacher | |
| 7,287,351 | B1 | 10/2007 | Warren | |
| 7,296,376 | B2 | 11/2007 | Kidd | |
| 7,451,566 | B1 | 11/2008 | Price | |
| 8,261,481 | B1 * | 9/2012 | Shebaro | 42/113 |
| 2010/0088944 | A1 * | 4/2010 | Callihan | 42/145 |
| 2013/0255129 | A1 * | 10/2013 | Curry | 42/144 |

FOREIGN PATENT DOCUMENTS

WO WO 97/32176 * 9/1997

* cited by examiner

*Primary Examiner* — Stephen M Johnson

(57) ABSTRACT

The invention encompasses firearm sights configured to eliminate the effect of parallax a shooter would otherwise experience when aiming a firearm at a target. The firearm sight utilizes a rear sight vane and at least one occluder positioned so that the occluder interferes with or substantially blocks a shooter's line of sight for the shooter's non-aiming eye without obstructing the vision of the correct eye with which the shooter should be aiming.

20 Claims, 6 Drawing Sheets

FIREARM SIGHT AND METHOD FOR OCCLUDING VISION OF SHOOTER'S NON-AIMING EYE

This U.S. non-provisional patent application claims the benefit of U.S. provisional patent application Method and Device for Occluding Vision of Non-Shooting Eye While Shooting a Firearm, application No. 61/685,754 filed Mar. 22, 2012.

FIELD OF THE INVENTION

The present invention relates to firearm sights, and more specifically to a firearm sight positioned to occlude the shooter's line of sight of his non-aiming eye so as to reduce the effect of parallax while shooting a firearm.

BACKGROUND OF THE INVENTION

Gun sights are well known in the art and encompass a variety of types. Generally, gun sights comprise a front sight member and an axially spaced rear sight vane, and the user visually aims the gun by aligning his line of sight between the rear sight vane, front sight, and the target. However, a common problem for a user of any of these variety of visually aimed gun sights is the effect of parallax. Parallax is the apparent displacement, or the difference in apparent direction, of an object as seen from two different points not on a straight line with the object. Often, an object will appear to shift position when viewed from two different points not on a straight line with the object.

A user will commonly experience the effect of parallax when visually aiming a gun when the user has both eyes open. The vision of the user's non-aiming eye may interfere with the vision of the user's aiming eye, and because each eye is located at a different point not on a straight line with the target this causes the target to appear to shift while aiming the gun at the target.

SUMMARY OF INVENTION

In describing the preferred embodiments, certain terminology will be utilized for the sake of clarity. Such terminology is intended to encompass the recited embodiment, as well as all technical equivalents, which operate in a similar manner for a similar purpose to achieve a similar result.

The present invention encompasses a firearm sighting device that interferes with the line of sight of a shooter's non-aiming eye while shooting to reduce the effect of paralax. When aiming and shooting a firearm, the user should aim at a target using only one eye (the shooting eye) in order to accurately hit the target at which the user is aiming. If the shooter aims with both eyes, or with the non-shooting eye, the effect of parallax causes an apparent shift of the target by viewing the target from two different points (each eye) not on a straight line with the target. This decreases the accuracy of the user's aim.

There are many types of firearm sights. Some firearm sights comprise an aperture sight consisting of a front sight and rear sight vane combination in which the user aligns the front sight in the rear sight vane with the target.

The present firearm sight comprises a frame, which may either be contiguous with, attached or detachably connected to a firearm, and a visual occluder. The occluder occludes the vision of the user's non-shooting eye so that when the visual occluder is used by the user as the user is aiming at a target, the occluder interferes with the line of sight for the shooter's non-shooting eye. This automatically forces the user to utilize the user's shooting eye when aiming at the target. By occluding the vision of the non-shooting eye, the effect of parallax is eliminated. The user views the target with only his shooting eye viewed through the firearm sight. The occluder may be opaque or semi-transparent, so long as the vision of the non-shooting eye is obstructed enough for the user's brain to automatically switch to his or her shooting eye to aim at the target.

DETAILED DESCRIPTION OF A PREFERRED EMBODIMENT

Figure 1:
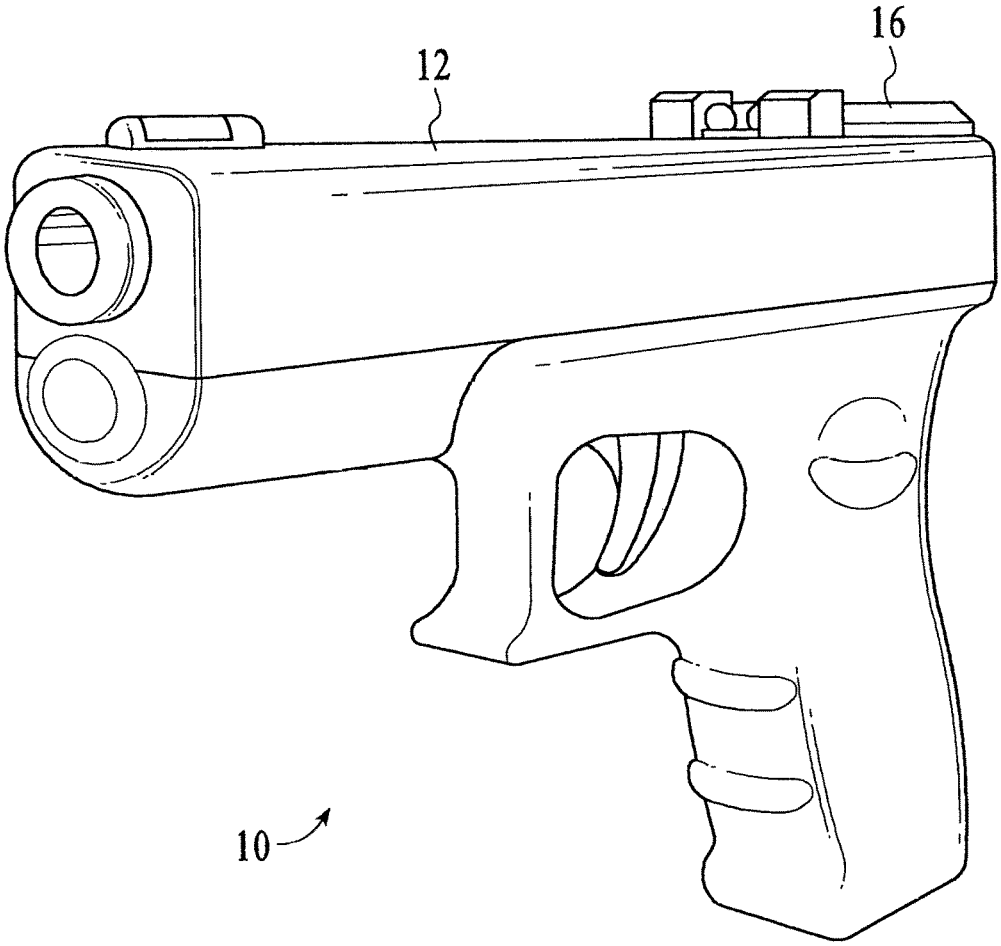
FIG. 1 is a perspective view of a firearm and firearm sight according to a first preferred embodiment of the invention.
Figure 2:
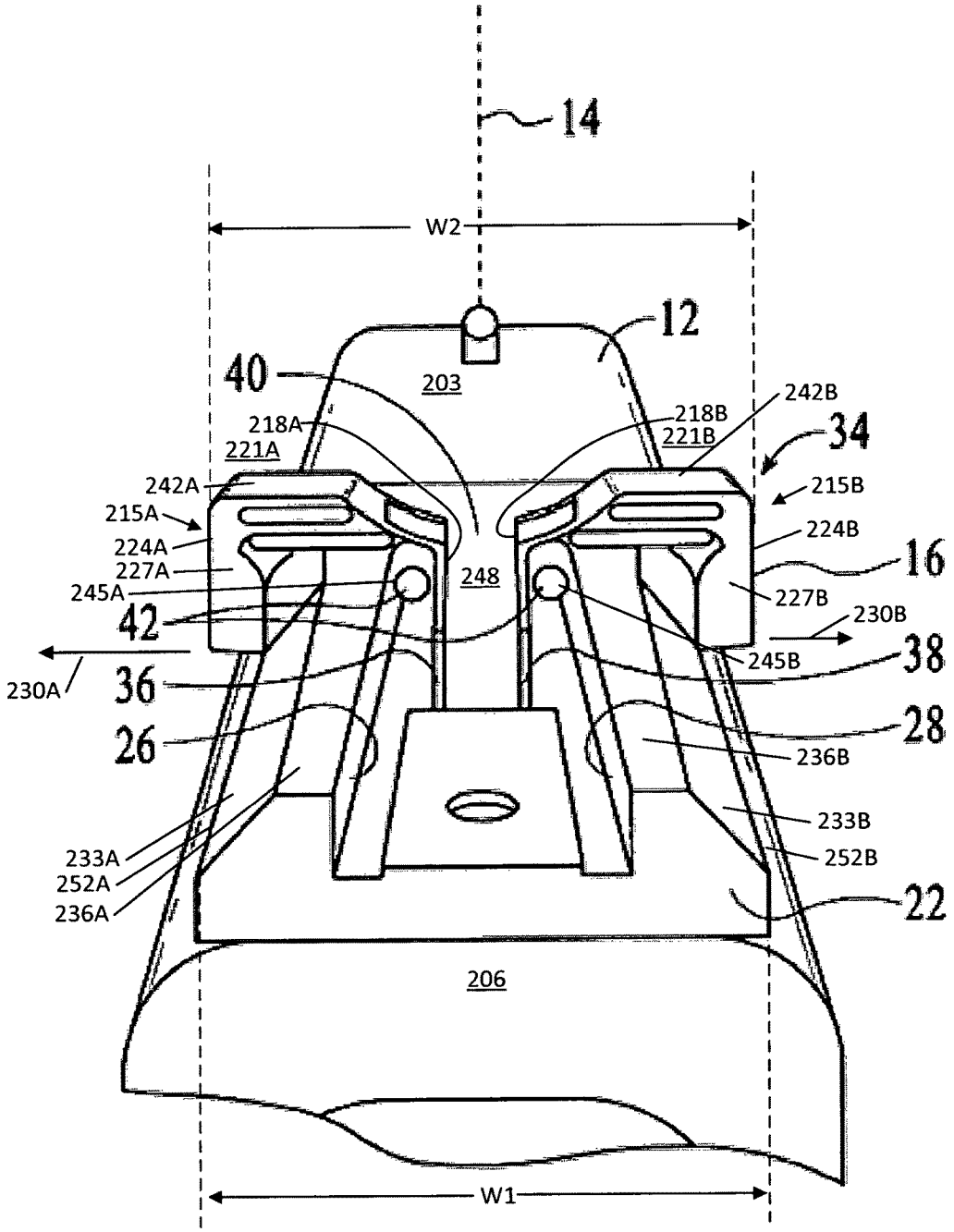
FIG. 2 illustrates a perspective view of a firearm sight according to a first preferred embodiment of the invention.
Figure 3:
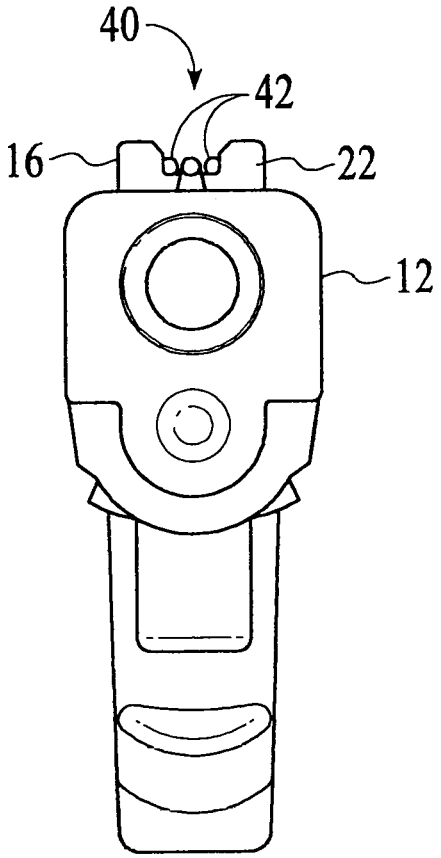
FIG. 3 illustrates a front view of a first embodiment of the invention.

FIGS. 1-5 illustrate an embodiment of the present invention that may be used on a semi-automatic pistol 10. Pistol 10 in FIG. 1 includes a barrel 12. Longitudinal axis 14 is generally aligned with a barrel 12 of a firearm such as pistol 10. The preferred embodiment of the present invention may also be used on various other firearms, including, but not limited to, rifles, shotguns, revolvers and automatic pistols. FIG. 1 illustrates a firearm sight 16 that extends along a portion of longitudinal axis 14 of barrel 12. Referring now to FIG. 2, FIG. 2 illustrates one embodiment of the present invention in which sight 16 comprises a frame 22 and tapered first and second sidewalls 26 and 28, respectively, substantially aligned with longitudinal axis 14. First sidewall 26 may be referred to as a left sidewall. Second sidewall 28 may be referred to as a right sidewall. An optical axis 30 of sight 16 is substantially aligned with longitudinal axis 14 so that a shooter 32 aiming pistol 10 would aim his line of sight along optical axis 30. Sight 16 comprises at least one occluder 34. Occluder 34 may be contiguous with a tapered sidewall 26 or 28, or may be mounted to sidewall 26 or 28. Occluder 34 is positioned along optical axis 30 so that occluder 34 interferes with or blocks shooter 32's line of sight of shooter 32's non-aiming eye. Occluder 34 may extend outward transversely from longitudinal axis 14, blocking shooter 32's line of sight of the non-aiming eye.

Figure 4:
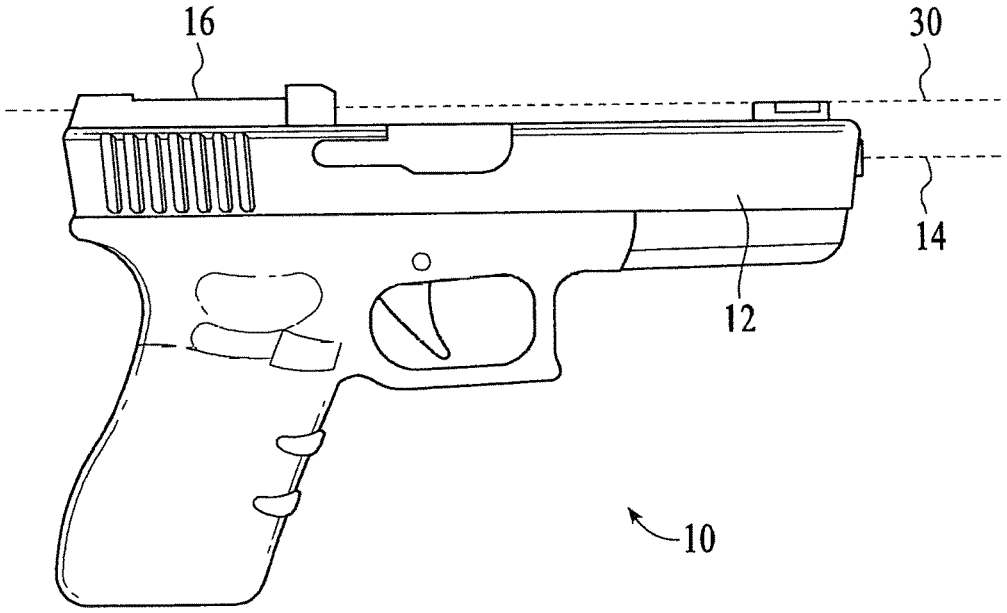
FIG. 4 illustrates a side view of a first embodiment of the invention.
Figure 5:
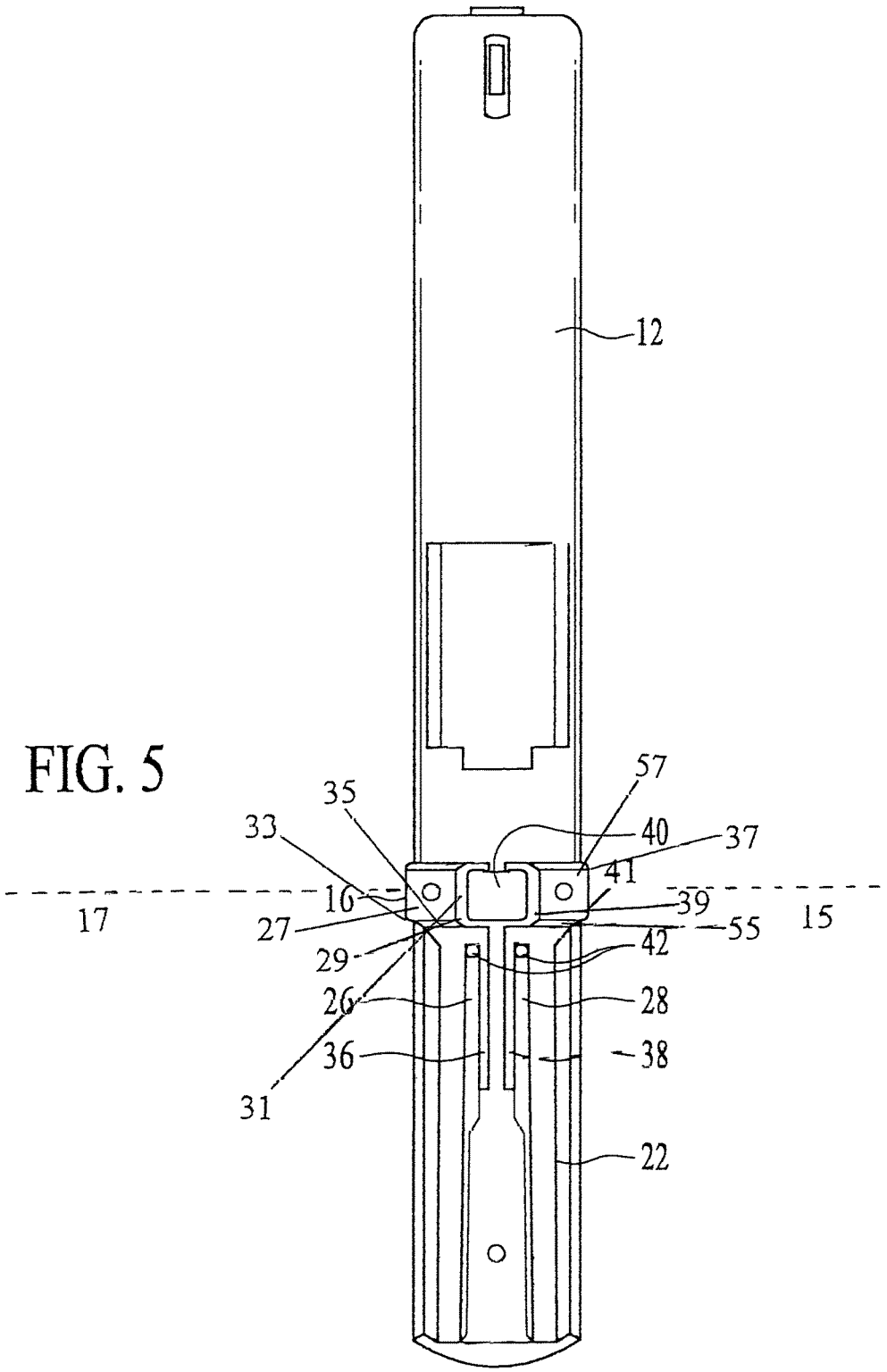
FIG. 5 illustrates a top view of a first embodiment of the invention.

As shown in the example of FIG. 2, the sight frame includes a front end 203, a rear end 206, opposite the front end. The occluder includes first and second occluder portions 215A and 215B, respectively. The first occluder portion may be referred to as a left occluder portion. The second occluder portion may be referred to as a right occluder portion. The left (or first) occluder portion includes a first inner edge 218A defining a left side 221A of the rear sight vane, a first outer edge 224A, opposite the first inner edge, and a left (or first) face 227A between the first inner and outer edges. The left face faces the rear end of the sight frame and extends outwards past the left (or first) sidewall in a first direction 230A. The first direction is transverse to an optical axis of sight 30 (FIG. 4). In other words, referring now to FIG. 2, in this view the optical axis is perpendicular into the drawing sheet and the occluder faces are in a plane transverse to the optical axis.

The right (or second) occluder portion includes a second inner edge 218B defining a right side 221B of the rear sight vane, a second outer edge 224B, opposite the second inner edge, and a right (or second) face 227B between the second inner and outer edges. The right face faces the rear end of the sight frame and extends outwards past the right (or second) sidewall in a second direction 230B that is transverse to the optical axis of sight. A gap 248 is between the first inner and second inner edges.

A left (or first) side surface 233A of the left sidewall tapers towards a left side of the firearm. The left side surface may be referred to as a left (or first) sidewall side surface. A right (or second) side surface 233B of the right sidewall tapers towards a right side of the firearm, opposite the left side of the firearm. The right side surface may be referred to as a right (or second) sidewall side surface. More particularly, the left sidewall includes a left (or first) sidewall top surface 236A and left (or first) sidewall side surface 233A, connected to the left sidewall top surface, that tapers down towards a left side of the firearm. Specifically, the first sidewall side surface tapers down towards a first sidewall edge 252A. The second sidewall side surface tapers down towards a second sidewall edge 252B. The second sidewall includes a right (or second) sidewall top surface 236B. A first width W1 is between the first and second sidewall edges. A second width W2 is between the first outer edge of the left occluder portion and the second outer edge of the right occluder portion. As shown in FIG. 2, the second width is greater than the first width.

The left occluder portion includes a left (or first) occluder top surface 242A that is perpendicular to the left face. The left occluder top surface is higher than the left sidewall top surface. The right occluder portion includes a right (or second) occluder top surface 242B that is perpendicular to the right face.

One embodiment of the present invention further comprises flutes 36 and 38 positioned between and substantially parallel to tapered sidewalls 26 and 28. Flutes 36 and 38 are raised and located so as to further interfere with or block shooter 32's line of sight of shooter 32's non-aiming eye. Flute 36 may be referred to as a left (or first) flute. Flute 38 may be referred to as a right (or second) flute.

Sight 16 may further comprise optical fibers 42 to assist shooter 32 with aiming the firearm. In an embodiment of the invention, optical fibers 42 may be located on opposing sides of rear sight vane 40 of pistol 10. There can be a left (or first) optical fiber end 245A and a right (or second) optical fiber end 245B.

Figure 6:
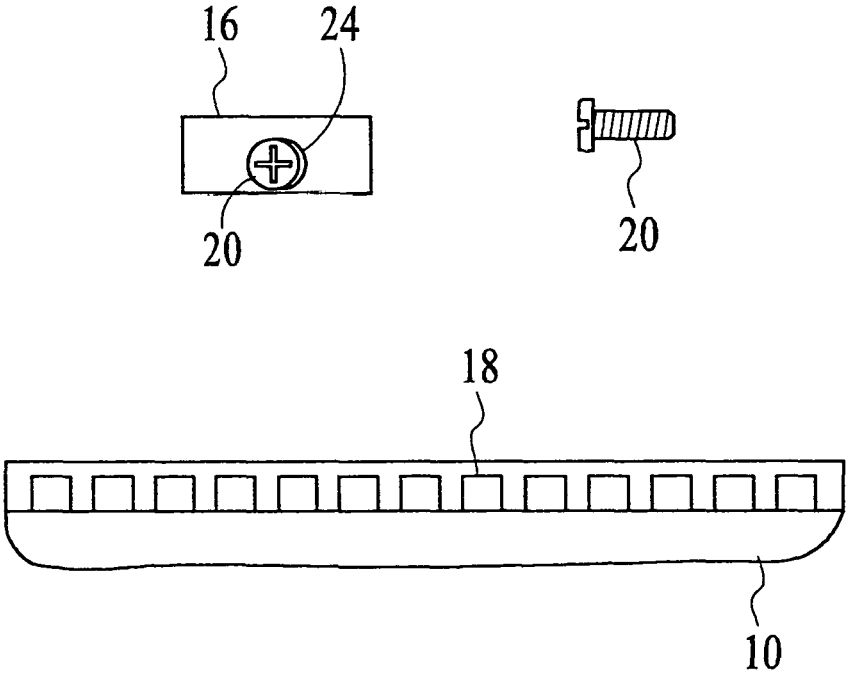
FIG. 6 is a partial side view of a portion of one embodiment of the firearm sight with receptor and fastener for mounting on the tactical rail of a firearm.

Sight 16 may either be contiguous with, attached or detachably connected to a firearm, or a firearm component. In an embodiment, frame 22 of sight 16 comprises at least one receptor 24 capable of being matingly coupled with a tactical rail 18 of pistol 10. At least one fastener 20 can be incorporated to secure receptor 24 of sight 16 to tactical rail 18. Frame 22 may be detachably connected by a fastener 20, said fastener 20 including, but not limited to, a screw, nut, bolt, clamp, or other fastening structure. FIG. 6 illustrates a portion of a firearm sight capable of receiving a fastener that may be mounted to the tactical rail of a firearm.

Alternately, frame 22 and/or occluder 34 may be integrally formed or contiguous to firearm sight 16. In one embodiment, occluder 34 is an integrally formed extension of rear sight vane 40 of pistol 10. In this embodiment, occluder 34 is positioned on the same side of the rear sight vain 40 corresponding to the side of shooter 32's non-aiming eye. In various embodiments, frame 22 may be attached to or mounted on a component of the firearm, such as, but not limited to, a gun light, or other accessory device capable of mounting on the firearm.

Once the line of sight of shooter 32's non-aiming eye is occluded, shooter 32's brain automatically uses the vision of only his aiming eye to aim the firearm at the target.

Occluder 34 is contiguous with the rear sight vane 40 so that sight vain 40 extends in width and is positioned along optical axis 30 so as to interfere with or block shooter 32's line of sight of his non-aiming eye.

Occluder 34 may be used with traditional rear sight vains, or sight vains utilizing lenses such as those disclosed in U.S. Pat. No. 4,375,725. For sight vains utilizing lenses, occlude 34 obstructs shooter 32's vision of his or her non-aiming eye, and the lens enhances the vision in shooter 32's shooting eye so that shooter 32's eye does not have to accommodate by focusing between a front sight, rear sight, and target.

In various embodiments, occluder 34 is typically a width of at least 10 mm and no greater than 70 mm, and preferably between 31 mm and 50 mm wide. Occluder 34 must be wide enough to occlude the vision of shooter 32's non-aiming eye, taking into account the variation in the distance of inter pupillary distance for different users. In various embodiments, occlude 34 and frame 22 are comprised of a variety of materials, including, but not limited to, metal, plastic, composite, carbon, or graphite.

Those skilled in the art will appreciate that various adaptations and modifications of the just-described preferred embodiments can be configured without departing from the scope and spirit of the invention. Other suitable fabrication, manufacturing, assembly, and test techniques known in the art can be applied in numerous specific modalities by one skilled in the art and in light of the description of the present invention described herein. Therefore, it is to be understood that the invention may be practiced other than as specifically described herein. The above description is intended to be illustrative, and not restrictive. Many other embodiments will be apparent to those of skill in the art upon reviewing the above description. The scope of the invention should, therefore, be determined by reference to the knowledge of one skilled in the art and in light of the disclosures presented above.

What is claimed is:

1. A firearm sight, said firearm sight comprising:

a. A sight frame capable of being mounted on a firearm, the sight frame comprising:
   - a front end;
   - a rear end, opposite the front end, the rear end of the sight frame to be positioned closer to a rear of the firearm than a front of the firearm when the sight frame is mounted on the firearm;
   - a left sidewall; and
   - a right sidewall, opposite the left sidewall, the left and right sidewalls extending from the rear end of the sight frame towards the front end of the sight frame;

b. A rear sight vane at the front end of said sight frame, wherein an optical axis of sight passes between the left and right sidewalls and through the rear sight vane towards the front of the firearm; and c. An occluder at the front end of the sight frame and positioned so that said occluder interferes with or blocks a shooter's line of sight for the shooter's non-aiming eye without obstructing the vision of the correct eye with which the shooter should be aiming, wherein the occluder comprises:

a left occluder portion on a left side of the optical axis of sight, the left occluder portion comprising:

a first inner edge defining a left side of the rear sight vane;

a first outer edge, opposite the first inner edge; and a left face between the first inner and outer edges, wherein the left face faces the rear end of the sight frame and extends outwards past the left sidewall in a first direction that is transverse to the optical axis of sight; and a right occluder portion on a right side of the optical axis of sight, opposite the left side of the optical axis of sight, the right occluder portion comprising:

a second inner edge defining a right side of the rear sight vane, opposite the left side of the rear sight vane;

a second outer edge, opposite the second inner edge; and a right face between the second inner and outer edges, wherein the right face faces the rear end of the sight frame and extends outwards past the right sidewall in a second direction that is transverse to the optical axis of sight and opposite the first direction.

2. The firearm sight of claim 1 wherein a first side surface of the left sidewall tapers towards a left side of the firearm, and wherein a right side surface of the right sidewall tapers towards a right side of the firearm, opposite the left side of the firearm, said firearm sight further comprising a pair of tapered sidewalls mounted on said frame.

3. The firearm sight of claim 1 wherein the left tapered sidewall comprises:

a left sidewall top surface; and a left sidewall side surface, coupled to the left sidewall top surface, that tapers down towards a left side of the firearm; and wherein the left occluder portion comprises a left occluder top surface that is perpendicular to the left face, wherein the left occluder top surface is higher than the left sidewall top surface.

4. The firearm sight of claim 1 wherein the left occluder portion is contiguous with and integrally formed with the left sidewall.

5. The firearm sight of claim 1 wherein a width of the occluder is between the first outer edge and the second outer edge, and wherein the width ranges from about 31 mm to about 50 mm.

6. The firearm sight of claim 1 wherein said occluder is capable of being detachably coupled to an end of the left and right sidewalls.

7. The firearm sight of claim 1 comprising:

a left flute between the left and right sidewalls, wherein the left flute is on the left side of the optical axis of sight, and extends in a direction parallel to the optical axis of sight.

8. The firearm sight of claim 7 comprising:

a right flute, next to the left flute, and the left and right sidewalls, wherein the right flute is on the right side of the optical axis of sight, and extends in the direction parallel to the optical axis of sight.

9. The firearm sight of claim 1 wherein the sight frame is capable of being removably attached to a breech end of the firearm.

10. The firearm sight of claim 1 wherein the sight frame comprises at least one receptor capable of being matingly coupled with a firearm tactical rail.

11. The firearm sight of claim 10 further comprising at least one fastener capable of securing said receptor to said firearm tactical rail.

12. The firearm sight claim 11 wherein said fastener is a screw, bolt, pin, nut or clamp.

13. The firearm sight of claim 1 comprising:

a left optical fiber end on the left side of the rear sight vane; and a right optical fiber end on the right side of the rear sight vane, each of the left and right optical fiber ends being reflective, fluorescent, or illuminated.

14. The firearm site of claim 1 wherein the sight frame comprises a fluorescent or illumenescent material coating a portion of said frame, the material capable of fluorescing or illuminating light so as to increase visibility while the shooter is aiming the firearm.

15. A firearm sight, said firearm sight comprising:

an occluder comprising a first occluder portion, and a second occluder portion, the first occluder portion comprising:

a first inner edge;

a first outer edge, opposite the first inner edge; and a first face between the first inner and outer edges;

the second occluder portion comprising:

a second inner edge;

a second outer edge opposite the second inner edge; and a second face between the second inner and outer edges, wherein a gap formed between the first inner and second inner edges define a rear sight vane through which an optical axis of sight passes;

a first sidewall extending away from the first face in a direction parallel to the optical axis of sight, the first sidewall comprising a first sidewall side surface that tapers down towards a first sidewall edge; and a second sidewall extending away from the second face in the direction parallel to the optical axis of sight, the second sidewall comprising a second sidewall side surface that tapers down towards a second sidewall edge, wherein a first width is between the first and second sidewall edges, a second width is between the first outer edge of the first occluder portion and the second outer edge of the second occluder portion, and wherein the second width is greater than the first width.

16. The firearm sight of claim 15 wherein the first occluder portion comprises a first top surface that is perpendicular to the first face, wherein the first sidewall comprise a first sidewall top surface coupled to the first sidewall side surface, and wherein the first top surface of the first occluder portion is higher than the first sidewall top surface of the first sidewall.

17. The firearm sight of claim 15 comprising a pair of flutes between the first and sidewalls, wherein the optical axis of sight passes through a gap formed between a first flute of the pair of flutes and a second flute of the pair of flutes.

18. The firearm sight of claim 17 comprising a first optical fiber end, and a second optical fiber end, wherein the first optical fiber end is between the first flute and the first sidewall, and the second optical fiber end is between the second flute and the second sidewall.

19. The firearm sight of claim 15 wherein the first and second faces are in a plane transverse to the optical axis of sight.

20. A firearm sight comprising:

an occluder comprising first and second occluder portions, the first occluder portion comprising:

a first inner edge;

a first outer edge, opposite the first inner edge;

a first face, between the first inner and outer edges; and a first top surface, coupled to the first face at an angle relative to the first face;

the second occluder portion comprising:

a second inner edge;

a second outer edge, opposite the second inner edge;

a second face, between second inner and outer edges; and a second top surface, coupled to the second face at an angle relative to the second face;

a rear sight vane defined by a gap between the first inner edge of the first occluder portion and the second inner edge of the second occluder portion;

a first sidewall extending from the first face in a direction parallel to a line of sight passing through the rear sight vane, the first sidewall comprising:

a first sidewall side surface that tapers down towards a first sidewall edge; and a first sidewall top surface, coupled to the first sidewall side surface;

a second sidewall extending from the second face in the direction parallel to the line of sight, the second sidewall comprising:

a second sidewall side surface that tapers down towards a second sidewall edge; and a second sidewall top surface, coupled to the second sidewall side surface;

a first flute, between the first and second sidewalls, the first flute extending from the first face of the first occluder portion in the direction parallel to the line of sight;

a first optical fiber end on the first face of the first occluder portion and positioned between the first flute and the first sidewall;

a second flute, between the first and second sidewalls, the second flute extending from the second face of the second occluder portion in the direction parallel to the line of sight; and a second optical fiber end on the second face of the second occluder portion and positioned between the second flute and the second sidewall, wherein a length of the first and second flutes is less than a length of the first and second sidewalls, wherein the line of sight passes through a gap between the first and second flutes, wherein the first top surface of the first occluder portion is higher than the first sidewall top surface, wherein the second top surface of the second occluder portion is higher than the second sidewall top surface, wherein a first width is between the first outer edge of the first occluder portion and the second outer edge of the second occluder portion, wherein a second width is between the first sidewall edge and the second sidewall edge, and wherein the first width is greater than the second width.

* * * * *